US009941077B2

(12) United States Patent
Ding et al.

(10) Patent No.: US 9,941,077 B2
(45) Date of Patent: Apr. 10, 2018

(54) COMPUTER THIN FILM SWITCH KEYBOARD

(71) Applicant: SHENZHEN HUI CHUANG DA TECH. CO. LTD., Shenzhen (CN)

(72) Inventors: JinXin Ding, Shenzhen (CN); Xiaopeng Cao, Shenzhen (CN); Ming Li, Shenzhen (CN); Guishun Hong, Shenzhen (CN); Xiaojun Hong, Shenzhen (CN)

(73) Assignee: SHENZHEN HUI CHUANG DA TECH. CO. LTD., Shenzhen, Guangdong (CN)

( * ) Notice: Subject to any disclaimer, the term of this patent is extended or adjusted under 35 U.S.C. 154(b) by 83 days.

(21) Appl. No.: 15/068,226

(22) Filed: Mar. 11, 2016

(65) Prior Publication Data

US 2016/0196937 A1 Jul. 7, 2016

Related U.S. Application Data

(63) Continuation of application No. PCT/CN2013/081437, filed on Aug. 14, 2013.

(30) Foreign Application Priority Data

Jul. 12, 2013 (CN) ..... 2013 1 0292955
Jul. 12, 2013 (CN) ..... 2013 1 0292974

(51) Int. Cl.
*H01H 13/83* (2006.01)

(52) U.S. Cl.
CPC ..... *H01H 13/83* (2013.01); *H01H 2205/026* (2013.01); *H01H 2213/00* (2013.01);
(Continued)

(58) Field of Classification Search
CPC ..... H01H 13/83; H01H 2219/062; H01H 2219/044; H01H 2219/036; H01H 3/125;
(Continued)

(56) References Cited

U.S. PATENT DOCUMENTS

2002/0094838 A1 7/2002 Wang
2010/0108486 A1* 5/2010 Yoshida ..... H01H 13/85 200/520

(Continued)

FOREIGN PATENT DOCUMENTS

CN 201928336 8/2011
CN 202839410 3/2013

OTHER PUBLICATIONS

English translation of International Search Report for PCT/CN2013/081437, dated Apr. 22, 2014, two pages total.

*Primary Examiner* — Ahmed Saeed
(74) *Attorney, Agent, or Firm* — Hamre, Schumann, Mueller & Larson, P.C.

(57) ABSTRACT

The present invention discloses a computer thin film switch keyboard, wherein the keyboard comprises keys/keycaps, a light guide film, a fixing film/air hole layer, metal domes, an air slot layer, a conductive film/PCB and a key plate, the key plate is disposed at the lowest layer, the conductive film/PCB is disposed above the key plate, the air slot layer is disposed above the conductive film/PCB, the metal domes are disposed on the conductive film/PCB, more than one metal dome is disposed corresponding to key configurations on the keyboard, the fixing film/air hole layer is disposed above the metal domes, and the keys/keycaps are disposed above the fixing film/air hole layer. The present invention has characteristics of being light, thin, and easy to carry, and having a Bluetooth function, a short stroke, and lower noises, etc.

10 Claims, 8 Drawing Sheets

(52) U.S. Cl.
CPC ... *H01H 2213/01* (2013.01); *H01H 2219/036* (2013.01); *H01H 2219/044* (2013.01); *H01H 2219/06* (2013.01); *H01H 2219/062* (2013.01); *H01H 2219/064* (2013.01)

(58) Field of Classification Search
CPC ..... H01H 2219/06; H01H 2201/018; H01H 13/06; H01H 2223/002; H01H 9/04; H01H 2209/048; H01H 13/063; H01H 13/14; H01H 1/125
USPC ..... 200/5 A, 344, 310–314, 341, 520, 512, 200/306, 515, 302.1, 302.2
See application file for complete search history.

(56) References Cited

U.S. PATENT DOCUMENTS

| | | | | |
|---|---|---|---|---|
| 2011/0017580 | A1* | 1/2011 | Ozaki | G02B 6/0043 200/314 |
| 2012/0112933 | A1* | 5/2012 | Chen | G06F 1/1626 341/27 |
| 2012/0298496 | A1* | 11/2012 | Zhang | H01H 3/125 200/5 A |
| 2016/0196936 | A1* | 7/2016 | Ding | G06F 1/1632 361/679.09 |

* cited by examiner

COMPUTER THIN FILM SWITCH KEYBOARD

BACKGROUND

Technical Field

The present invention discloses a computer keyboard, in particular, to a computer thin film switch keyboard.

Related Art

As computer techniques continuously develop, and costs of computer consumable items are gradually democratized, a computer is popularized in daily lives of people, and the computer almost cannot be separated from the daily lives of people. A keyboard, as an essential accessory of the computer, plays an extremely important role in the process of using of the computer. The computer keyboard in the prior art usually relates to several kinds, such as a PS/2 interface wired keyboard, a USB interface wired keyboard, an RFID wireless external keyboard, and a Bluetooth wireless keyboard lights. However, regardless of which kind of keyboard, the key structure adopts a structure with a keycap cooperated with a poly cap or adopts a conventional scissor keys (or referred to as X structure keys). The entire thickness of the keyboard cannot be reduced due to the reason of its own structure regardless of whether it is a keyboard having the structure with a keycap cooperated with a poly cap or a keyboard having the scissor structure, thus the thickness of the entire finished product is large, and it is not easy to carry. Gradually, the psychological needs of people for pursuing lighting and thinning and portability cannot be met.

The conventional keyboard is quite inconvenient without a backlight function for inputting at night or at a place where the light is dark. Marks on the keyboard cannot be clearly seen unless depending on the light emitted from the display screen of the computer or from illumination from an external light only. After long time usage, the marks on the keycaps of the keyboard may be worn, thus it is more inconvenient for inputting.

A touch keyboard is also developed on the current market. The type of keyboard can be light and thin; however, during usage, it lacks a sense of key travel due to the adopted touch structure. In other words, completely no hand feelings exist. During inputting, it feels like typing on a tablet; and when pressing a key, an operator is completely unaware of whether a function is input. Moreover, the area of the keyboard is small and the arrangement of the keys is very tight; therefore, a mistyping phenomenon would be easily caused during inputting.

SUMMARY

Regarding the abovementioned computer keyboard in the prior art, the entire thickness thereof is relatively large, while a touch keyboard has a disadvantage of lacking a sense of key travel. The present invention provides an ultrathin metal dome and key computer keyboard that can solve the abovementioned problems. The ultrathin metal dome and key computer keyboard adopts ultrathin metal domes as an input device, is a product obtained from a combination of various objects, and it has characteristics of being light, thin, and easy to carry, and having light emitting keys, a short stroke, and lower noises, etc.

The technical solution adopted by the present invention to solve the technical problem thereof is: a computer thin film switch keyboard, wherein the keyboard comprises keys/keycaps, a light guide film, a fixing film/air hole layer, metal domes, an air slot layer, a conductive film/PCB and a key plate, the key plate is disposed at the lowest layer, the conductive film/PCB is disposed above the key plate, the air slot layer is disposed above the conductive film/PCB, the metal domes are disposed on the conductive film/PCB, more than one metal dome is disposed corresponding to key configurations on the keyboard, the fixing film/air hole layer is disposed above the metal domes, and the keys/keycaps are disposed above the fixing film/air hole layer.

The technical solutions adopted by the present invention further include:

A decorating part is disposed on the keys/keycaps, keycap holes are opened in the decorating part, and the keys/keycaps extend from the keycap holes to the external of the decorating part.

A light guide film is disposed above the fixing film/air hole layer, light guide dots are disposed on the light guide film, an LED light source is disposed at a side surface of the light guide film, and the keys/keycaps are disposed above the light guide film.

The light guide dots are convex dots or concave dots.

The light guide dots on the light guide film are disposed corresponding to the keys/keycaps.

A plunger convex dot layer is disposed above the fixing film/air hole layer, and the light guide film is disposed above the plunger convex dot layer.

The light guide film is adhered to the plunger convex dot layer via a first double sided adhesive or glue, and the fixing film/air hole layer is adhered to the plunger convex dot layer via a second double sided adhesive or glue.

Conductive substrate convex dots are disposed on the keycaps/keys.

Gas ports are opened in the fixing film/air hole layer.

The air holes are disposed at an edge position of the metal domes.

metal dome holes for mounting metal domes 7 are disposed on the air slot layer, and adjacent two or three metal dome holes are communicated with each other via air slots.

One or more metal domes are disposed below each of the keys/keycaps.

The beneficial effects of the present invention are: the present invention adopts metal domes with a long life, a long stroke, high sensitivity, and a low pressing force as a basis for mechanic actions, so as to generate hand feelings when a hand presses a keycap. The gram force value of the metal domes adopted by the present invention is similar to that of conventional scissor keys, wherein the gram force value is between 30-200 gf, the pressing stroke of the keyboard is between 0.10 mm to 1.00 mm, and the sensitivity is between 25% and 85%. The present invention, regarding the light guide material of 0.10-0.50 mm optical level, uses a cold pressing manner or hot pressing manner to manufacture light emitting spots of micro-nanostructure. By improving the structure, side light emitting LEDs are used as the light source, and through an optical design method, the key surface is enabled to emit light uniformly and softly and high luminance can be obtained. The breakover part of the key of the present invention adopts the PCB or conventional conductive film as a material for connecting electric appliance. The terminal, such as the key and the tablet PC, adopts an RF or a Bluetooth output control manner or wired connection manner. The keycap, the PCB or conductive film, the Bluetooth module, the metal domes and the like are then assembled as one module, to be installed inside a housing, so as to form an integrated finished product of "an ultrathin metal dome portable computer keyboard." The entire produce of the present invention is light, thin, simple and convenient for installation and detachment, has good hand feelings, and is easy to carry. The ultrathin metal dome portable computer keyboard of the present invention would be a great innovation in the keyboard industry, and would bring a revolutionary reform to the conventional keyboard industry.

The present invention will be further explained by combining the accompany drawings and specific embodiments as follows.

Figure 1:
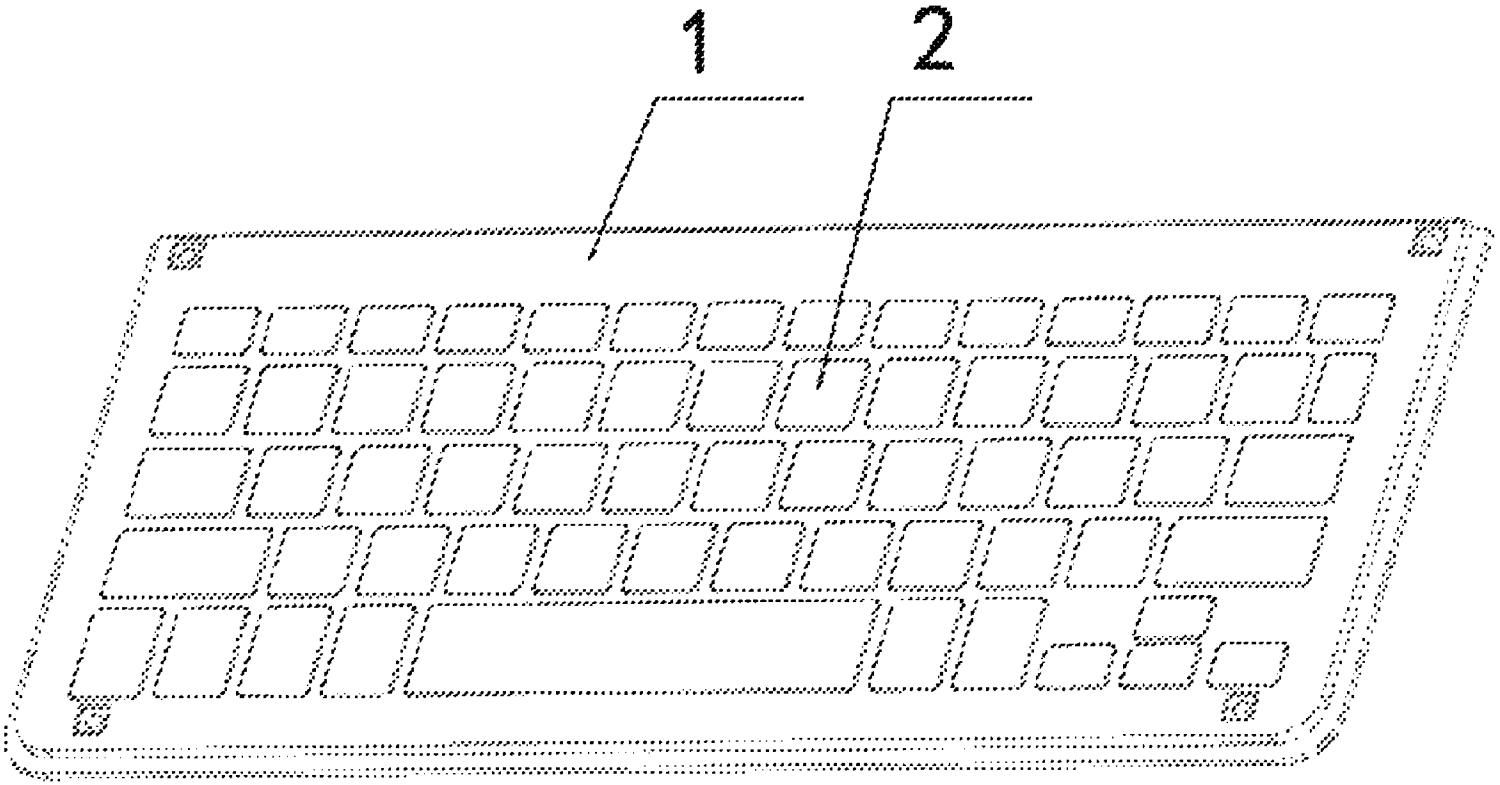
FIG. 1 is an overall three-dimensional structural schematic diagram of the present invention.

In the drawings, 1—a decorating part, 2—keys and keycaps, 3—a first double sided adhesive or glue, 4—a plunger convex dot (conductive substrate) layer, 5—a second double sided adhesive or glue, 6—a fixing film/air hole layer, 7—metal domes (dome), 8—an air slot layer, 9—a conductive film or PCB, 10—a key plate, 11—a Bluetooth module, 12—a light guide film, 13—an LED light source, 14—a power source, 15—a connector, 16—light guide dots, 17—threaded holes for the decorating part, 18—a double sided adhesive tape or glue for the decorating part, 19—keycap holes, 20—conductive substrate convex dots, 21—a positioning column, 22—a conductive substrate carrier, 23—plunger, 24—air holes, 25—metal dome holes, 26—an air slot, 27—A Bluetooth and battery cap, 28—screws, 29—a double sided adhesive for a cover plate, 30—a battery, 31—a Bluetooth chip, 32—a USB interface, 33—a switch, 34—a conductive film, 35—a pin, 36—a switch line, 37—a golden finger, 38—a light guide double sided adhesive or glue, and 39—a second PCB plate.

DETAILED DESCRIPTION

The present embodiment is a preferable embodiment of the present invention, and other embodiments with principles and basic structures same as or similar to those of the present embodiment all fall within the scope of protection of the present invention.

Figure 2:
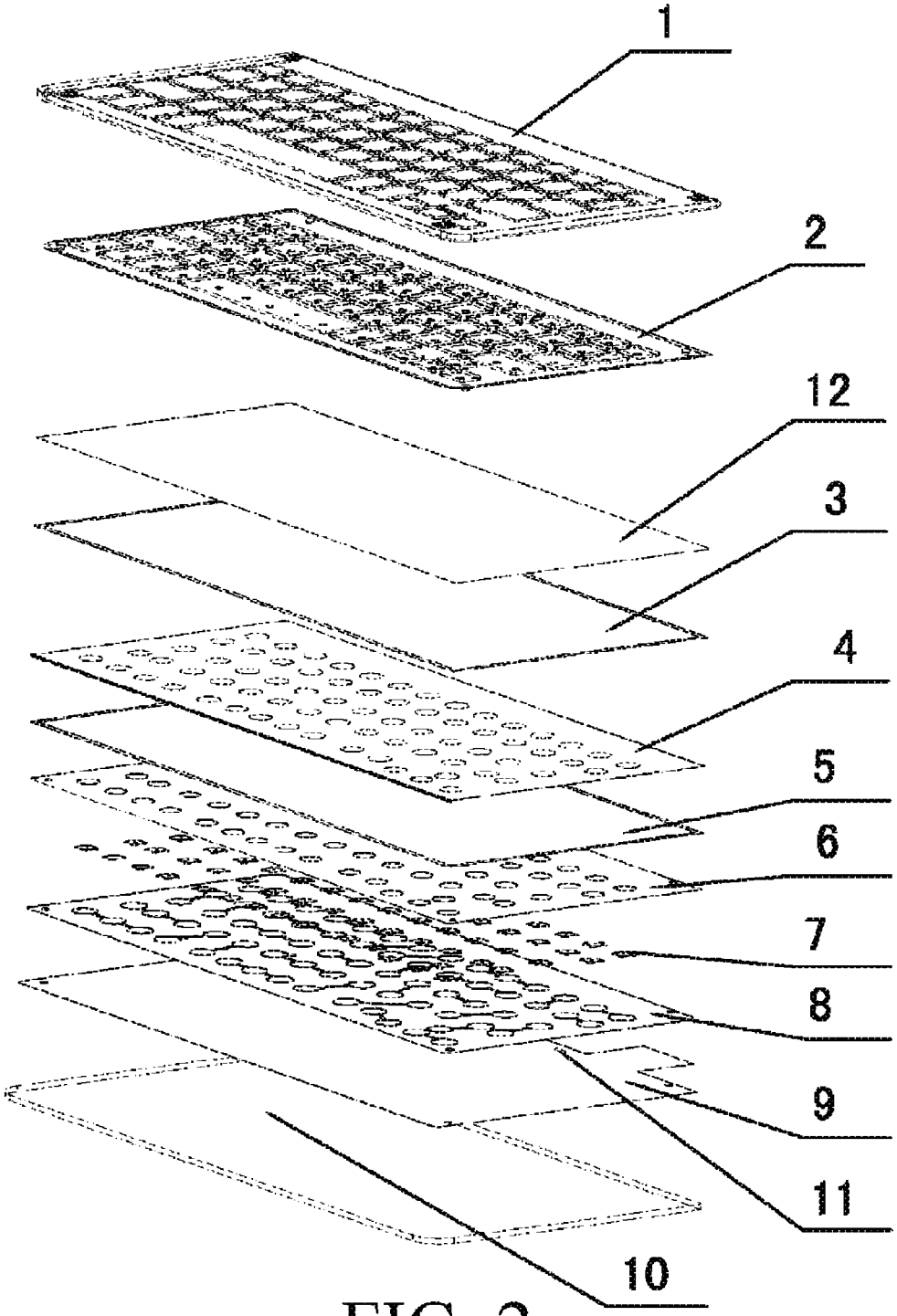
FIG. 2 is an exploded state structural schematic diagram of the present invention.

With reference to FIG. 1 and FIG. 2, the present invention mainly includes a decorating part 1, keys/keycaps 2, a light guide film 12, a first double sided adhesive or glue 3, plunger convex dots 4, a second double sided adhesive or glue 5, a fixing film/air hole layer 6, metal domes 7, an air slot layer 8, a conductive film or PCB 9 and a key plate 10, wherein the key plate 10 is disposed at the lowest layer, and is s a bottom plate of the present invention to for the function of bottom supporting and protecting, the conductive film or PCB 9 is disposed above the key plate 10, the air slot layer 8 is disposed above the conductive film or PCB 9, more than one metal domes 7 are disposed corresponding to key configurations on the keyboard, one or more metal domes 7 are disposed at each key, the fixing film/air hole layer 6 is disposed above the metal domes 7, for fixing the metal domes 7, the plunger convex dot layer 4, or referred to as the conductive substrate, is disposed above the fixing film/air hole layer 6, the fixing film/air hole layer 6 is adhered to the plunger convex dot layer 4 via the second double sided adhesive or glue 5, the light guide film 12 is disposed above the plunger convex dot layer 4, the light guide film 12 is adhered to the plunger convex dot layer 4 via the first double sided adhesive or glue 3, a set of light guide dots 16 is disposed on the light guide film 12 corresponding to each key, one or more LED light sources 13 are disposed on the side surface of the light guide film 12, the light guide double sided adhesive or glue 38 is disposed above the light guide film 12, for adhering the light guide film 12 on the keys and keycaps 2, the keys and keycaps 2 are disposed above the light guide film 12, and the decorating part 1 is disposed over the keys and keycaps 2 for the function of decorating on one hand and for the functions of fixing and protecting on the other hand. In the present embodiment, threaded holes are respectively disposed at four corners of each layer, and each layer is fixedly installed with each other via screws.

Figure 3:
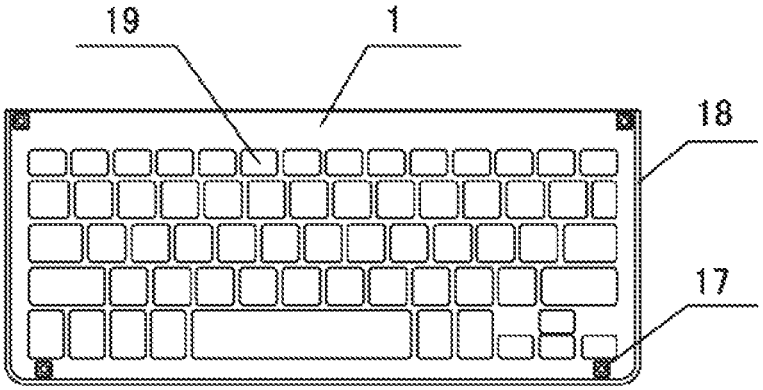
FIG. 3 is a decorating part structural schematic diagram of the present invention.

Specific structures among various layers of the present invention are further explained with reference to the accompany drawings as follows:

As combined with the reference to FIG. 3, in the present embodiment, the decorating part layer is mainly the decorating part 1, one decorating part threaded hole 17 is respectively opened at four corners of the decorating part 1, and a decorating part double sided adhesive tape or glue 18 is respectively disposed at the periphery of the decorating part 1. The decorating part 1 is adhered onto the key plate 10 via the decorating part double sided adhesive tape or glue 18, and keycap holes 19 are opened in the decorating part 1 for the keycaps to extend from the keycap holes 19 to the external of the decorating part. In the present embodiment, the decorating part 1 is placed on a surface of the keycaps and keys 2, the keys and keycaps 2 passing through the keycap holes 19 on the decorating part 1, and the decorating part 1 is fixed on the key plate 10 by screwing the screws at the decorating part threaded holes 17. Meanwhile, the periphery thereof is also fixed on the key plate 10 using the decorating part double sided adhesive tape or glue 18. In the present embodiment, the decorating part 1 is made of the type of materials of plastics, metals, paperboard, or cloth, and mainly has the functions of decorating and fixing, and the decorating part 1 and the key plate 10 constitute a housing structure of the present invention. In the present embodiment, the thickness of the decorating part 1 is between 0.1-3.0 MM.

Figure 4:
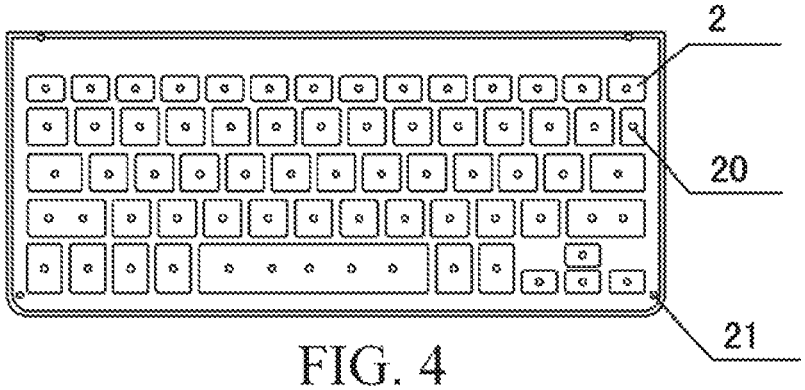
FIG. 4 is a structural schematic diagram of keys and keycaps of the present invention.

As combined with the reference to FIG. 4, in the present embodiment, the conductive substrate convex dots 20 are disposed on the keycaps and keys 2, and one positioning column 21 is respectively disposed at the four corner of the keycap and key layer, for the convenience of accurate positioning during assembly. In the present embodiment, a desired character and pattern is printed on each of the keycaps and keys 2, and one conductive substrate convex dot 20 is disposed on the opposite side of each of the keys and keycaps 2. In the present embodiment, the conductive substrate convex dot 20 is located above the metal dome, for the function of improving hand feelings. In the present embodiment, the material of the keycaps and keys 2 is the type of material of silica gel and plastics, and the entire thickness of the bottom is 0.2-2.5 mm. In the abovementioned embodiment and drawings, disposing the conductive substrate convex dots 20 on the keycaps and keys 2 is taken as an example to specifically explain the structure thereof. During specific implementation, no conductive substrate convex dot may be disposed on the keycaps and keys 2. Regardless whether to dispose the conductive substrate convex dots, the abovementioned embodiments both fall within the scope of protection of the present invention.

Figure 5:
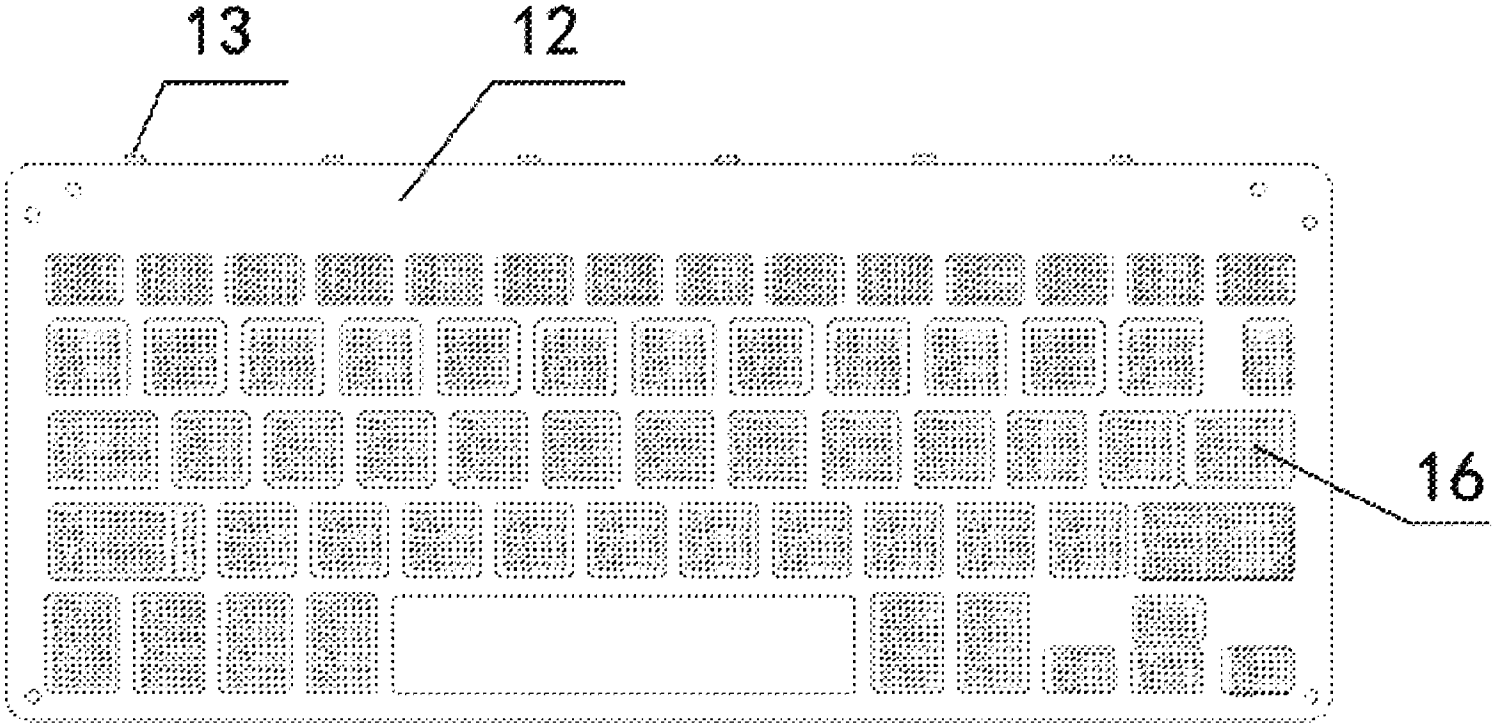
FIG. 5 is a structural schematic diagram of LGF of the present invention.
Figure 6:
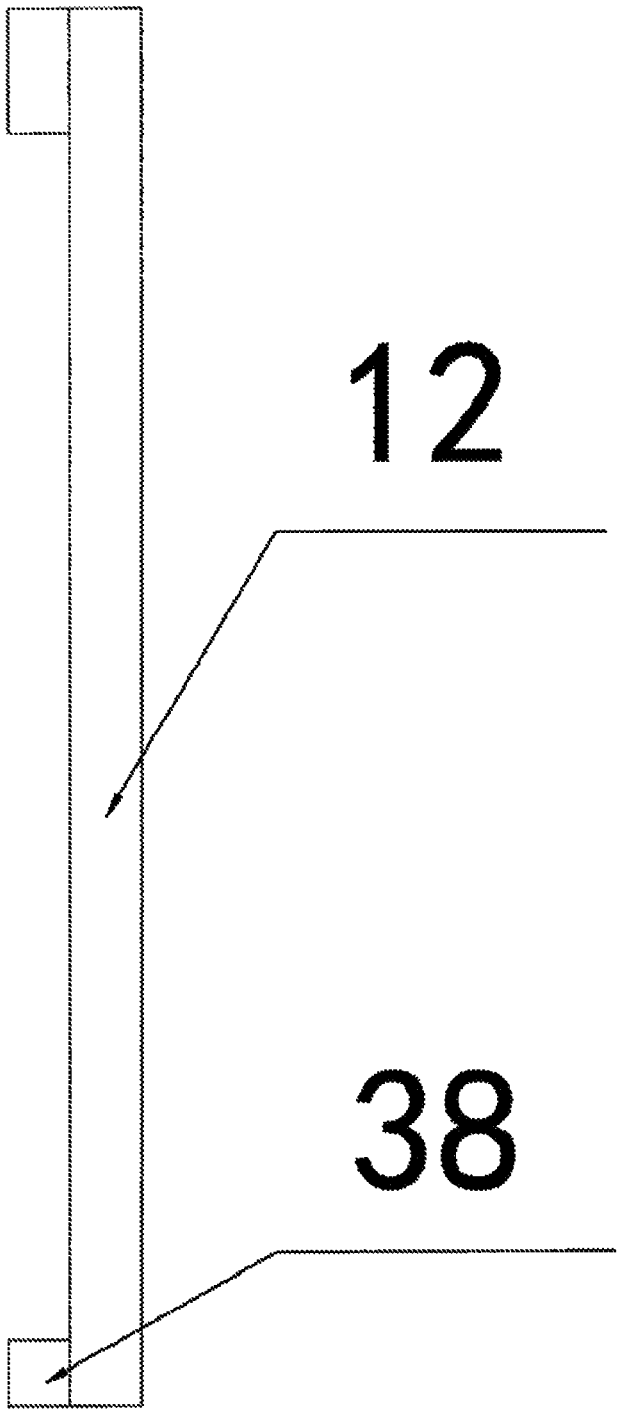
FIG. 6 is a side structural schematic diagram of LGF of the present invention.

As combined with the reference to FIG. 5 and FIG. 6, in the present embodiment, the light guide dots 16 are disposed on the light guide film 12 (also referred to as LGF), the approach for manufacturing the light guide dots 16 is die stamping (concave dots) or printing (convex dots), one or more LED light sources 13 are disposed on the side surface (which may be one, two, three, or four surfaces) of the light guide film 12, and the light guide double sided adhesive or glue 42 is disposed on the back surface of the light guide film 12, to fix the light guide film 12 on the keys 2 to achieve the aim of emitting light from the keyboard. In the present embodiment, the thickness of the light guide body 38 is between 0.10-0.50 mm. When powering the LED light sources 13, the LED light sources 13 start to emit light. An area light source is formed through transmission of light via the light guide film 12, then refraction of light via the light emitting net points 16, and reflection, so as to illuminate the characters on the keys and keycaps.

Figure 7:
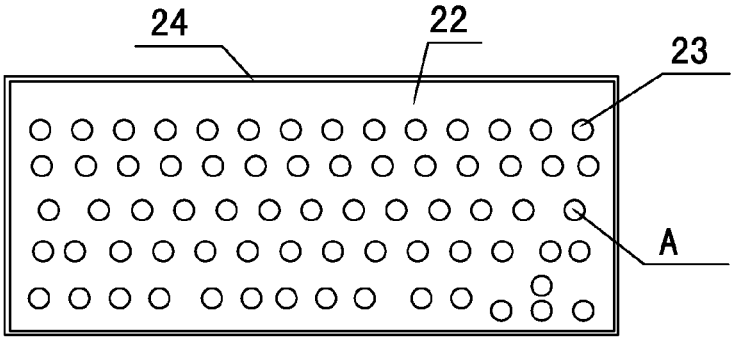
FIG. 7 is a structural schematic diagram of plunger (i.e., the conductive substrate) of the present invention.
Figure 8:
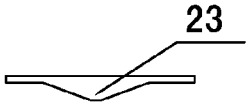
FIG. 8 is a partially enlarged side structural schematic diagram of A in FIG. 7.

As combined with the reference to FIG. 7 and FIG. 8, in the present embodiment, the conductive substrate layer 4 mainly includes a conductive substrate carrier 22 and plunger 23, the plunger 23, i.e., the conductive substrate, is disposed above the conductive substrate carrier 22, so that the key is always pressed on a center position of the metal dome 7 during pressing, and a pressing area of the metal dome 7 is reduced at the same time, for the functions of prolonging the life of the key, and improving the hand feelings. The conductive substrate double sided adhesive tape or glue is disposed at the periphery of the conductive substrate carrier 22, to enable the conductive substrate carrier 22 to be fixedly installed on the fixing film/air hole layer 6.

Figure 9:
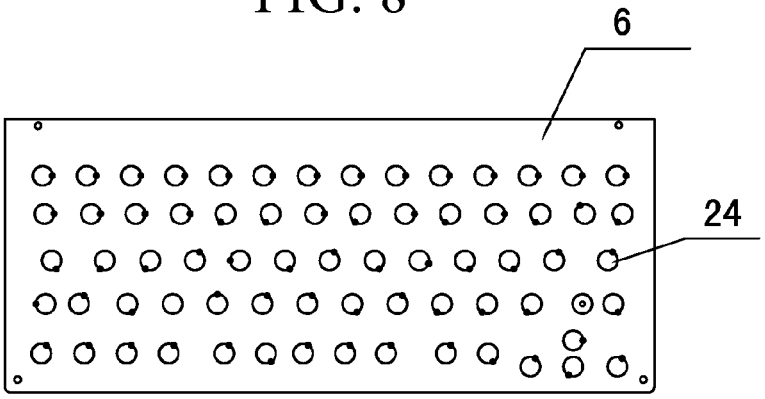
FIG. 9 is a structural schematic diagram of a fixing film (for fixing metal domes) of the present invention.

As combined with the reference to FIG. 9, in the present embodiment, the fixing film/air hole layer 6 mainly is a matrix provided with a glue, to fix the metal domes 7 thereon, meanwhile, the metal domes 7 are adhered on the air slot layer 8, the air holes 24 are opened in the matrix, for excluding air generated during pressing the metal domes 7, and meanwhile, the hand feelings for pressing can be improved. The air holes 24 are generally disposed at the position of the edge of metal domes 7.

Figure 10:
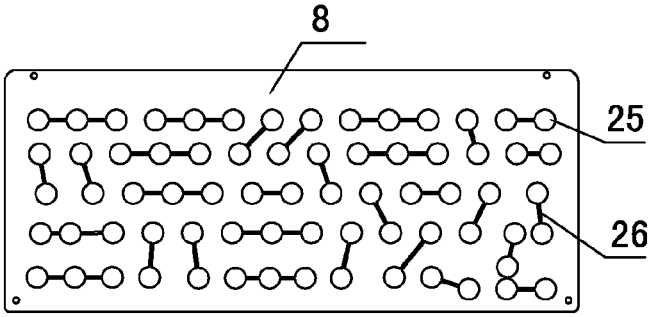
FIG. 10 is a structural schematic diagram of an air slot of the present invention.

As combined with the reference to FIG. 10, in the present embodiment, the air slot layer 8 mainly relates to disposing metal dome holes 25 on the air slot carrier for installing the metal domes 7. More than two neighboring metal dome holes 25 are communicated with each other via the air slot 26, for the function of improving the hand feelings of the keys. In the present embodiment, a glue is provided on the air slot carrier, and the air slot carrier is adhered to the conductive film or PCB plate 9 via the glue.

Figure 11:
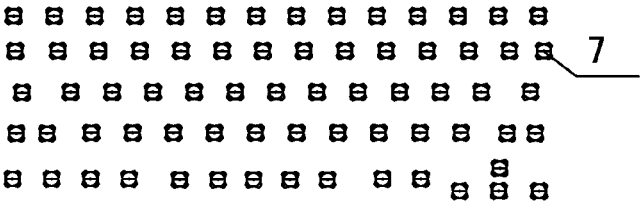
FIG. 11 is a structural schematic diagram of the metal domes of the present invention.

As combined with the reference to FIG. 11, in the present embodiment, a plurality of metal domes 7 are provided, one or more metal domes 7 are disposed below each of the keys and keycaps 2, and the metal domes 7 are adhered to the fixing film 6 via the holes 25 for receiving METLA DOMEs on the air slot layer, for the functions of providing mechanical hand feelings as well as breakover when pressing the keys. In the present embodiment, the diameter of the metal domes 7 is 3-15 mm. Metal domes with different sizes are selected according to the keys and keycaps with different sizes. In the present invention, the metal domes are also referred to as thin film switches, snap domes, dome sheets and the like in the industry.

Figure 12:
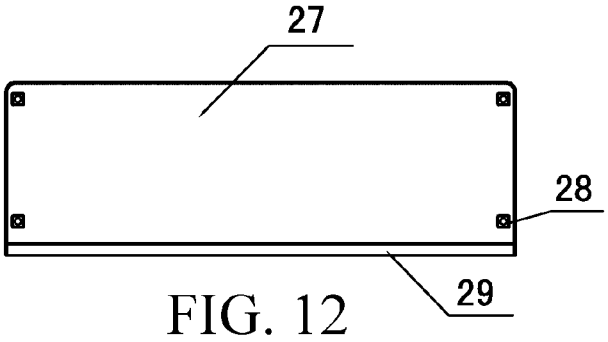
FIG. 12 is a structural schematic diagram of A Bluetooth and battery cap of the present invention.

As combined with the reference to FIG. 12, in the present embodiment, the Bluetooth and battery cap 27 is used to protect the battery and the Bluetooth module, etc. One screw 28 is respectively disposed at four corners of the Bluetooth and battery cap 27. The Bluetooth and battery cap 27 is fixedly installed on key bottom plate 10 via the screws 28. Meanwhile, the cover plate double sided adhesive tape 29 is further disposed at the side edge of the Bluetooth and battery cap 27 for the function of secondarily fixing via the cover plate double sided adhesive tape 29 while the Bluetooth and battery cap 27 is fixedly installed on the key plate 10.

Figure 13:
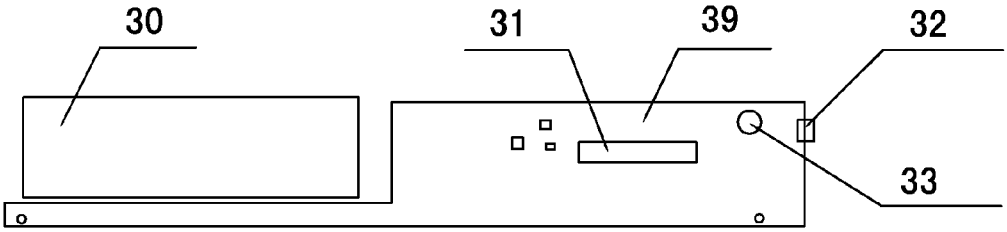
FIG. 13 is a structural schematic diagram of positions of a Bluetooth module and a battery of the present invention.

As combined with the reference to FIG. 13, in the present embodiment, an inner structure mainly includes the second PCB 39 and the battery 30, a Bluetooth chip 31 and a switch 33 is disposed on the second PCB 39, and a USB interface 32 is installed on the side surface of the PCB 9. The Bluetooth chip 31 is used to receive and send signals, and the battery 30 provides the power source for the present invention. When the battery 30 is out, the USB interface 32 can be used as an external power source for supplies, and charging the battery 30. The switch 33 is used to control the switch of the keyboard, the pairing of Bluetooth apparatuses, and the like. In the present embodiment, the second PCB 39 can be replaced by the conductive film (i.e., FPC).

Figure 14:
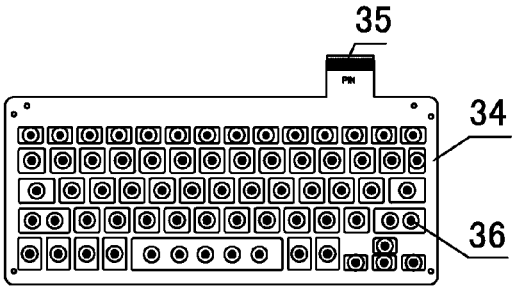
FIG. 14 is a structural schematic diagram of a first embodiment of PCB or a conductive film (line) of the present invention.

As combined with the reference to FIG. 14, in the present embodiment, in order to use the structure of the conductive film 34, a pin 35 (i.e., PIN) connected to the Bluetooth module is disposed on the conductive film 34, a switch line 36 is designed on the conductive film 34, and the METLA DOME module is attached to the surface of the conductive film 34. When METLA DOME is pressed, the switch line 36 forms an "on and off" state, and achieves the function of the key via the Bluetooth chip 31, to control a terminal apparatus such as a tablet PC.

Figure 15:
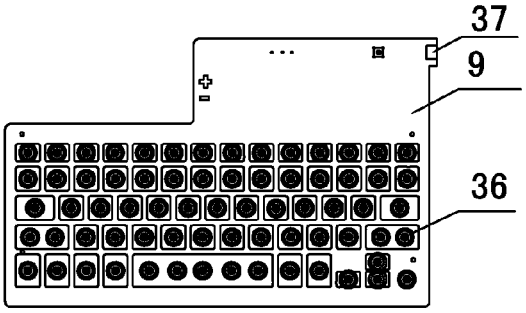
FIG. 15 is a structural schematic diagram of a second embodiment of PCB or a conductive film (line) of the present invention.

As combined with the reference to FIG. 15, in the present embodiment, in order to use the structure of PCB 9, the golden finger 37 is disposed on PCB 9, and the METLA DOME module is attached to the surface of PCB 9. When METLA DOME is pressed, the golden finger 37 forms an "on and off" state, and achieves the function of the key via the Bluetooth chip 31, to control a terminal apparatus such as a tablet PC.

Figure 16:
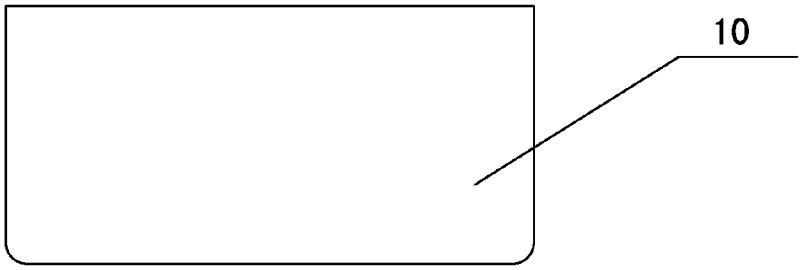
FIG. 16 is a structural schematic diagram of a key plate of the present invention.

As combined with the reference to FIG. 16, in the present embodiment, the key bottom plate 10 functions as supporting the entire keyboard.

In the present invention, during manufacturing, metal dome device holes and air slots/holes are first designed on a PET sheet material of 0.03-0.50 mm. In the present embodiment, the PET sheet material is divided into three layers, i.e., a release layer, a glue layer, and a surface material layer. Then another PET sheet material of 0.01-0.50 mm is covered on the PET surface material having the metal dome device holes and air slots/holes by using an automatic roll to roll laminator. metal domes are then attached to the PET sheet material of 0.01-0.50 mm using a chip mounter. The assembled metal dome module is then assembled on the PCB or conductive film, and the PCB or conductive film requires to be connected to the Bluetooth module, for the function of on/off, and the function of finally control the terminal machine (i.e., the tablet PC). PLNUGER is then attached on the metal dome module. The main function of plunger is to reduce the influence of the tolerance accumulated during the process of assembly and processing on bad hand feelings generated on the metal dome, and at the same time, plunger also has the function of improving the hand feelings, so that the pressing force is always maintained and applied on a dead center of the metal dome, thereby enabling the mechanic properties of the metal domes to be in the optimal state. LGF (i.e., the light guide film 12) with the thickness of 0.10-0.50 mm is further assembled on the surface of PLNGER. The light guide film 12 has a function of transmission of light. Side light emitting LEDs are used to be disposed at the periphery of the product as the light source, so that the entire surface of the keyboard uniformly emits light. The key is then assembled on the metal dome, a desired character, pattern and the like are printed on the key, and then printing ink or oil paint is printed or sprayed on the key, so that the desired font and pattern are formed on the surface of the key. The height of the key is between 0.1-2.0 mm, and materials of different thicknesses are selected according to different structures. The key module is assembled on the metal dome module, and the installation is completed by means of hot-pressing, fitting, suturing and adhering. The total thickness of the key part is not greater than 7 mm.

In the abovementioned embodiments, the Bluetooth keyboard is taken as an example to specifically explain the structure of the present invention. During specific implementations, the keyboard can be connected to the computer and the like via a wired manner, for example, via a data line; or can achieve wireless signal transmission etc. via an RF technique. The present invention can be widely applied to various desktop computers, notebook computers, all-in-one machines and the like, and can also be applied to the tablet PC including Tablet PC, Ipad, PAD, learning machine or ultrabook, and the like as an external keyboard.

The present invention adopts metal domes with a long life, a long stroke, high sensitivity, and a low pressing force as a basis for mechanic actions, so as to generate hand feelings when a hand presses a keycap. The gram force value of the metal domes adopted by the present invention is similar to that of conventional scissor keys, wherein the gram force value is between 30-200 gf, the pressing stroke of the keyboard is between 0.10 mm to 1.00 mm, and the sensitivity is between 25% and 85%. The present invention, regarding the light guide material of 0.10-0.50 mm optical level, uses a cold pressing manner or hot pressing manner to manufacture light emitting spots of micro-nanostructure. By improving the structure, side light emitting LEDs are used as the light source, and through an optical design method, the key surface is enabled to emit light uniformly and softly and high luminance can be obtained. The breakover part of the key of the present invention adopts the PCB or conventional conductive film as a material for connecting electric appliance. The terminal, such as the key and the tablet PC, adopts an RF or a Bluetooth output control manner or wired connection manner. The keycap, the PCB or conductive film, the Bluetooth module, the metal domes and the like are then assembled as one module, to be installed inside a housing, so as to form an integrated finished product of "an ultrathin metal dome portable computer keyboard." The entire produce of the present invention is light, thin, simple and convenient for installation and detachment, has good hand feelings, and is easy to carry. The ultrathin metal dome portable computer keyboard of the present invention would be a great innovation in the keyboard industry, and would bring a revolutionary reform to the conventional keyboard industry.

What is claimed is:

1. A computer thin film switch keyboard, comprising:
keys/keycaps;
a light guide film;
a fixing film/air hole layer;
metal domes;
an air slot layer;
a conductive film/PCB; and
a key plate,
wherein the key plate is disposed as a lowest layer, the conductive film/PCB is disposed above the key plate, the air slot layer is disposed above the conductive film/PCB, the metal domes are disposed on the conductive film/PCB, more than one metal dome is disposed corresponding to key configurations on the keyboard, the fixing film/air hole layer is disposed above the metal domes, and the keys/keycaps are disposed above the fixing film/air hole layer,
wherein the light guide film is disposed above the fixing film/air hole layer, light guide dots are disposed on the light guide film, an LED light source is disposed at a side surface of the light guide film, and the keys/keycaps are disposed above the light guide film,
wherein a plunger convex dot layer is disposed above the fixing film/air hole layer, and the light guide film is disposed above the plunger convex dot layer.

2. The computer thin film switch keyboard according to claim 1, wherein the light guide film is adhered to the plunger convex dot layer via a first double sided adhesive or glue, and the fixing film/air hole layer is adhered to the plunger convex dot layer via a second double sided adhesive or glue.

3. The computer thin film switch keyboard according to claim 1, wherein conductive substrate convex dots are disposed on the keycaps/keys.

4. The computer thin film switch keyboard according to claim 1, wherein air holes are opened in the fixing film/air hole layer.

5. The computer thin film switch keyboard according to claim 4, wherein the air holes are disposed at an edge position of the metal domes.

6. The computer thin film switch keyboard according to claim 1, wherein metal dome holes for mounting the metal domes are disposed on the air slot layer, and adjacent two or three metal dome holes are communicated with each other via air slots.

7. The computer thin film switch keyboard according to claim 1, wherein one or more metal domes are disposed below each of the keys/keycaps.

8. The computer thin film switch keyboard according to claim 1, wherein a decorating part is disposed on the keys/keycaps, keycap holes are opened in the decorating part, and the keys/keycaps extend from the keycap holes to an external of the decorating part.

9. The computer thin film switch keyboard according to claim 1, wherein the light guide dots are convex dots or concave dots.

10. The computer thin film switch keyboard according to claim 1, wherein the light guide dots on the light guide film are disposed corresponding to the keys/keycaps.

* * * * *